US007216513B2

(12) United States Patent
Miyai et al.

(10) Patent No.: US 7,216,513 B2
(45) Date of Patent: May 15, 2007

(54) APPARATUS FOR APPLYING SLIDING RESISTANCE FOR WEFT KNITTING MACHINE

(75) Inventors: Takuya Miyai, Wakayama (JP); Norio Kotaka, Wakayama (JP); Masanori Inumaki, Wakayama (JP); Hirokazu Nishitani, Wakayama (JP)

(73) Assignee: Shima Seiki Manufacturing Limited, Wakayama-shi (JP)

( * ) Notice: Subject to any disclaimer, the term of this patent is extended or adjusted under 35 U.S.C. 154(b) by 0 days.

(21) Appl. No.: 10/574,931

(22) PCT Filed: Oct. 7, 2004

(86) PCT No.: PCT/JP2004/014863
§ 371 (c)(1),
(2), (4) Date: Apr. 7, 2006

(87) PCT Pub. No.: WO2005/035855

PCT Pub. Date: Apr. 21, 2005

(65) Prior Publication Data

US 2007/0028652 A1 Feb. 8, 2007

(30) Foreign Application Priority Data

Oct. 10, 2003 (JP) ..... 2003-352986
Apr. 20, 2004 (JP) ..... 2004-124874

(51) Int. Cl.
*D04B 15/30* (2006.01)

(52) U.S. Cl. ..... 66/126 R

(58) Field of Classification Search ..... 66/126 R, 66/64, 60, 128, 127
See application file for complete search history.

(56) References Cited

U.S. PATENT DOCUMENTS 4,658,603 A * 4/1987 Stoll et al. ..... 66/126 R
4,909,048 A * 3/1990 Stoll et al. ..... 66/127
5,020,341 A 6/1991 Schimko
5,109,681 A * 5/1992 Schmid et al. ..... 66/126 R
5,588,311 A * 12/1996 Kiribuchi ..... 66/60 R
6,047,570 A * 4/2000 Shima ..... 66/126 R

FOREIGN PATENT DOCUMENTS

EP 0872587 A2 10/1998
JP A 3-280405 12/1991
JP 5-87963 B2 12/1993
JP 9-268455 A 10/1997
JP A 9-268455 10/1997
JP 2858768 B2 2/1999
JP B2 2858768 2/1999

* cited by examiner

*Primary Examiner*—Danny Worrell
(74) *Attorney, Agent, or Firm*—Harness, Dickey & Pierce, P.L.C.

(57) ABSTRACT

A permanent magnet applies first sliding resistance in-between a holding arm and a guide rail. A carriage is provided with an electromagnet for magnetically applying second sliding resistance in-between the holding arm and the carriage. Although the holding arm persists in moving through inertia when the carriage stops movement, a sliding resistance that is the sum of the first sliding resistance and the second sliding resistance acts on the holding arm, and it is possible to promptly stop. Since the second sliding resistance does not act when the carriage brings the holding member, it is possible to reduce a load. When the carriage starts bringing the holding arm, a difference between the first sliding resistance and the second sliding resistance becomes the sliding resistance, and it is possible to decrease sliding resistance that acts when bringing is started, and reduce occurrence of an impact and a noise.

8 Claims, 15 Drawing Sheets

APPARATUS FOR APPLYING SLIDING RESISTANCE FOR WEFT KNITTING MACHINE

TECHNICAL FIELD

The present invention relates to an apparatus for applying sliding resistance for a weft knitting machine, which applies sliding resistance to a moving member which is brought by a carriage and slides in a longitudinal direction of a needle bed in a weft knitting machine.

BACKGROUND ART

Conventionally, in a weft knitting machine, a plurality of knitting needles are disposed adjacent to each other to a needle bed, and knitting of a fabric is executed in a manner that a knitting yarn is fed while a knitting operation is sequentially executed with the knitting needles. The knitting operation sequentially executed with the knitting needles is executed by a cam mechanism for knitting mounted on a carriage moving along the needle bed, and a carrier brought by the carriage feeds the knitting yarn to the knitting needles.

FIG. 15 shows a schematic configuration of a mechanism in which a carriage brings a carrier. In a V-bed weft knitting machine in which a pair of needle beds located at the front and back confront at a needle bed gap, a yarn guide rail 1 serving as a guide rail is constructed above the needle bed gap. A bringing pin 3 is caused to appear and disappear in a part where a bridge 2 connecting the carriages disposed to the front and back needle beds crosses the yarn guide rail 1, thereby being capable of selectively bringing a carrier 4 serving as a moving member capable of traveling along the yarn guide rail 1. The carrier 4 is provided with a bringing recessed portion 5 with which the projected bringing pin 3 can engage.

A yarn feeding position to feed a knitting yarn to the knitting needle while knitting a fabric is set on a way in which the knitting needle is caused to retreat from the needle bed gap after being caused to advance to the needle bed gap by the knitting cam mounted on the carriage. In the case of using the knitting cam in common to move the carriage in one direction and move in the other direction, there is a need to switch the yarn feeding position to a different position with reference to the position of the knitting cam, in accordance with a moving direction of the carriage. In order that a yarn is fed to a position displaced a given distance with respect to the knitting cam in accordance with the moving direction of the carriage, the bringing recessed portion 5 has a specified width. When the carriage reverses the moving direction, a position in which the bringing pin 3 abuts against the bringing recessed portion is switched from one to the other between a right end 5*a* and a left end 5*b* of the bringing recessed portion 5.

When the bringing pin 3 is caused to subside from the side of the carriage that is moving along the knitted fabric, bringing of the carrier 4 by the carriage is stopped, and in a case where the carriage is moving, the carrier 4 persists in moving along the yarn guide rail 1 as well through inertia. However, it is desired that the carrier 4 remain in a position where the bringing has been stopped. This is because in a case where the carrier 4 moves before stopping from the position where engagement of the bringing pin 3 with the bringing recessed portion 5 has been released, the position becomes ambiguous when the carrier 4 is brought next with the bringing pin 3 projected.

In order that the carrier 4 having stopped being brought by the carriage is immediately stopped on the yarn guide rail 1, sliding resistance is applied in-between the carrier 4 and the yarn guide rail 1. The sliding resistance may be applied mechanically. The sliding resistance may be applied magnetically (for example, refer to Japanese Examined Patent Publication JP-B2 2858768).

Since the sliding resistance between the carrier 4 and the yarn guide rail 1 increases a moving load on the carriage when the carriage brings the carrier 4, it is preferred that the sliding resistance be small. However, there is a possibility that after the bringing stops, a distance necessary for the carrier 4 to stop gets long and a problem like an overrun occurs. The applicant of the present application proposed a technique of, in the case of utilizing magnetism in a weft knitting machine, using a magnetic circuit that includes a permanent magnet and an electromagnet and changing the strength of magnetism by passing pulsed electric current through the electromagnet (for example, refer to Japanese Unexamined Patent Publication JP-A 3-280405 (1991)).

In the case of only applying the sliding resistance in-between the carrier and the guide rail as disclosed in JP-B2 2858768, a load on the carriage that is bringing the carrier increases. In the case of mechanically applying the sliding resistance, wear-out is easy to occur as well. Further, when the carriage reverses, a position against which the bringing pin abuts in the bringing recessed portion with which the bringing pin engages changes.

For example, in FIG. 15, a case where the carriage moves rightward and knitting of one course ends, and the carriage moves leftward in knitting of the next course, will be assumed. While the carriage is moving rightward, the bringing pin 3 abuts against the right end 5*a* of the bringing recessed portion 5. Even if the carriage stops, the carrier 4 persists in moving more rightward through inertia. In a case where the sliding resistance is small, the carrier 4 continues movement rightward. When the bringing pin 3 is in a projected state, the left end 5*b* of the bringing recessed portion 5 abuts against the bringing pin 3, and the movement of the carrier 4 stops. When the bringing pin 3 is not projected, there is a possibility that the carrier 4 moves more rightward, that is, an overrun occurs. In a case where the overrun occurs, the bringing recessed portion 5 is away from the bringing pin 3 and cannot bring the carrier 4 even if the bringing pin 3 is projected so as to move the carriage leftward.

In a case where the sliding resistance of the carrier 4 to the yarn guide rail 1 is large, it is possible to stop the carrier 4 within a range where the carrier 4 can be brought by the bringing pin 3 at least when the carriage reverses the moving direction. However, since the carrier 4 is brought after the bringing pin 3 abuts against the left end 5*b* of the bringing recessed portion 5, an impact is generated when the bringing pin 3 abuts against the left end 5*b*. This impact gets larder as the sliding resistance of the carrier 4 to the yarn guide rail 1 is larger. It is feared that this impact causes a noise, and that repetition of the impact causes damage. Further, in the case of increasing a moving speed of the carriage in order to increase productivity, an impact and a noise get larger.

In the case of using an electromagnet as disclosed in JP-A 3-280405, it is possible to control applied sliding resistance by utilizing magnetism. However, it is difficult to mount a configuration including the electromagnet on the aforementioned carrier 4. It is desired that the carrier 4 traveling along the yarn guide rail 1 be as small in size and light in weight as possible. Mounting the configuration including the electromagnet on the carrier 4 results in increase of the weight and upsizing. Moreover, it becomes necessary to supply electric power for exciting the electromagnet.

DISCLOSURE OF INVENTION

An object of the invention is to provide an apparatus for applying sliding resistance for a weft knitting machine, which applies just only a small load on movement of a carriage and can stop promptly and securely when bringing thereof is stopped.

The invention is an apparatus for applying sliding resistance for a weft knitting machine, which applies sliding resistance to a moving member which is brought by a carriage and slides in a longitudinal direction of a needle bed in a weft knitting machine, the apparatus comprising:

a guide rail disposed in parallel to the longitudinal direction of the needle bed, the moving member being able to slidably move on the guide rail;

connection switching means which is capable of carrying out switching between a state where the moving member and the carriage are connected and the carriage brings the moving member, and a state where the connection is released and the carriage does not bring the moving member;

first sliding resistance applying means for applying first sliding resistance in-between the guide rail and the moving member; and second sliding resistance applying means for applying second sliding resistance in-between the moving member and the carriage, and making the second sliding resistance smaller than the first sliding resistance at least when the carriage reverses a moving direction.

Further, the invention is characterized in that:

the first sliding resistance applying means is provided with a first permanent magnet which generates magnetic attraction and applies the first sliding resistance; and the second sliding resistance applying means is provided with a second permanent magnet which generates magnetic attraction and applies the second sliding resistance smaller than the first sliding resistance.

Furthermore, the invention is characterized in that:

the first sliding resistance applying means is provided with a permanent magnet which generates magnetic attraction and applies the first sliding resistance; and the second sliding resistance applying means is provided with an electromagnet which generates magnetic attraction and applies the second sliding resistance, and which can control the magnetic attraction and make the second sliding resistance smaller than the first sliding resistance at least just before the moving member is brought, by switching of the connection switching means, into a state where it is brought by the carriage.

Still further, the invention is characterized in that the second sliding resistance applying means energizes the electromagnet and applies the second sliding resistance when the moving member being brought by the carriage is separated and stopped.

Still further, the invention is characterized in that when the moving member is separated, the second sliding resistance applying means excites the electromagnet so as to apply the second sliding resistance, and thereafter, demagnetizes the electromagnet and a magnetically attracting portion of the moving member.

Still further, the invention is characterized in that the second sliding resistance applying means excites the electromagnet by passing electric current of one direction therethrough, and demagnetizes by passing demagnetization electric current in a direction opposite to the one direction.

Still further, the invention is characterized in that the connection switching means has:

a controlling member disposed to one of the carriage and the moving member, being capable of controlling a deformation state; and a bringing member which is disposed to the other of the carriage and the moving member, and has an engagement place for bringing that can engage with the controlling member when the controlling member is in a predetermined deformation state.

Still further, the invention is characterized in that the moving member is a holding arm which holds a yarn carrier having a yarn feeding port for feeding a knitting yarn at a tip thereof, in a position where the yarn feeding port faces a knitting needle in knitting operation.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
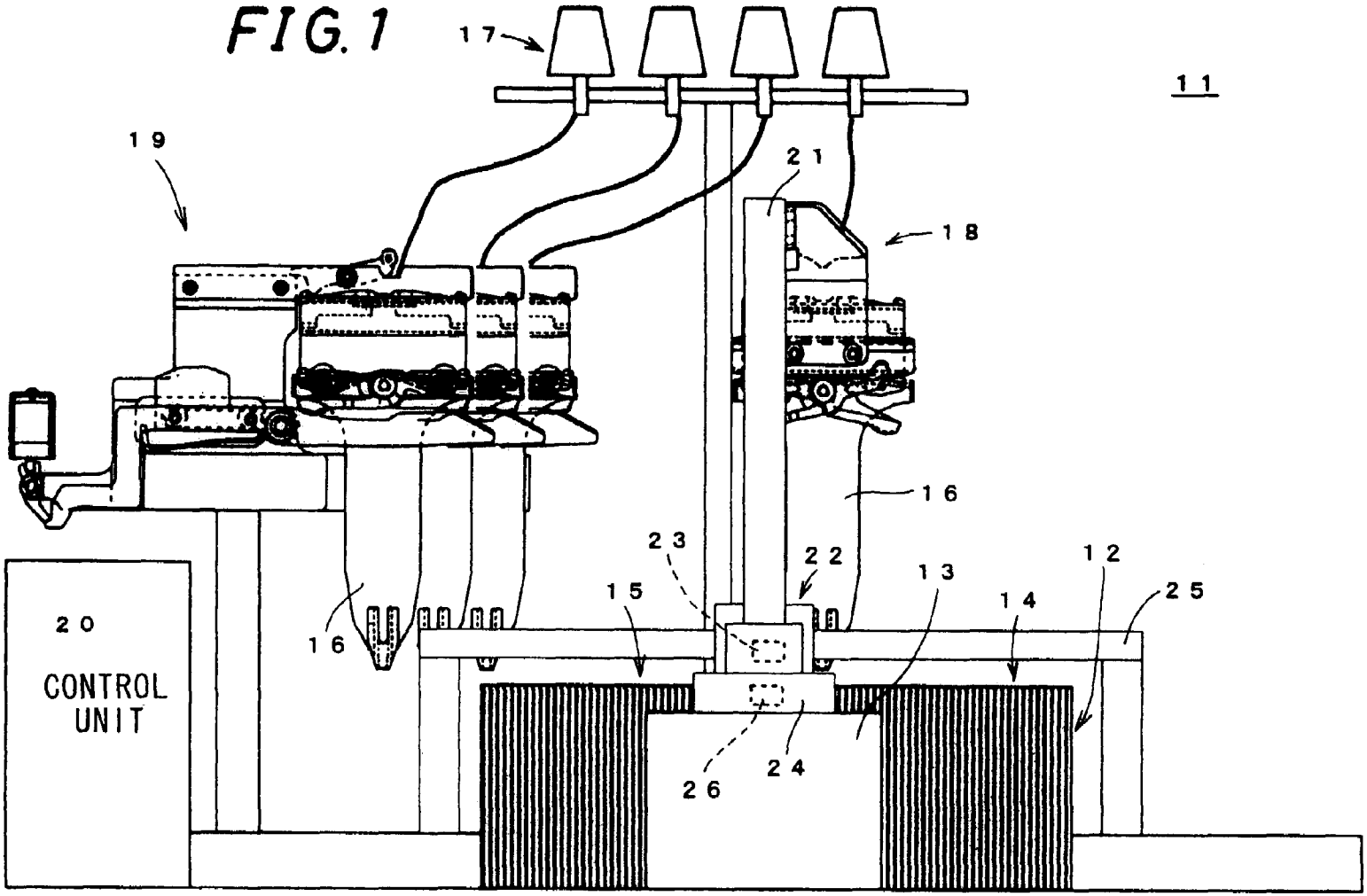
FIG. 1 is a front view showing a schematic configuration of a weft knitting machine 11 according to an embodiment of the invention.

Now referring to the drawings, preferred embodiments of the invention are described below.

FIG. 1 shows a schematic configuration of a weft knitting machine 11 as an embodiment of the invention. In the weft knitting machine 11, a fabric is knitted while a carriage 13 is caused to reciprocate along a needle bed 12. A pair of needle beds 12 are disposed at the front and back. To each of the needle beds 12, a number of knitting needles 14 are disposed adjacent to each other, and selectively execute an advancing motion and a retreating motion with respect to a needle bed gap 15 in which the pair of front and back needle beds 12 face each other, under the action of a knitting cam mounted on the carriage 13. The weft knitting machine 11 is a V-bed weft knitting machine in which the pair of front and back needle beds 12 face across the needle bed gap 15, and one of a plurality of yarn feeders 16 is selected and brought with the carriage 13. The yarn feeder 16 is a moving member, and while moving in a constant positional relationship with the carriage 13, feeds a knitting yarn to the knitting needles 14 and causes them to form stitch loops repeatedly, whereby a fabric can be knitted. It is possible to feed the knitting yarn to the yarn feeders 16 from yarn feeding apparatuses 17, respectively.

In the weft knitting machine 11, it is possible to selectively hold the plurality of yarn feeders 16 by a plurality of holders 18 disposed on the side of the carriage 13 and cause the carriage 13 to bring, as well as it is possible to halt an unselected yarn feeder 16 in a stopping device 19 disposed at an end portion of the needle bed 12, for example, at the left end. Moreover, the weft knitting machine 11 is provided with a control unit 20 that causes the carriage 13 to travel and executes selection of the knitting needle 14, and so on, in accordance with knitting data for knitting a fabric.

In the depth direction in the drawing, the plurality of holders 18 are placed on a holding arm 21. Also, a plurality of stopping devices 19 are arranged to the placement positions of the respective holders 18. Between the proximal end of the holding arm 21 and the carriage 13, a bringing state switching mechanism 22 is disposed. A permanent magnet 23 is also disposed to the holding arm 21. The bringing state switching mechanism 22 is capable of switching a bringing state of the carriage 13 and the holding arm 21. The bringing state switching mechanism 22 is capable of acting on a connecting portion 24 on the side of the carriage 13, and shifting a position to bring the holding arm 21 with respect to the carriage 13, as well as switching to a state not to bring. A guide rail 25 is disposed so that support of the holding arm 21 is kept and the position of the yarn feeder 16 or the like does not change even if the holding arm 21 is separated from the carriage 13. The guide rail 25 is constructed so as to become parallel to the longitudinal direction of the needle bed 12 along the needle bed gap 15.

The permanent magnet 23 is disposed to a part in which the holding arm 21 is supported by the guide rail 25 and makes sliding displacement in the longitudinal direction, and functions as the first sliding resistance applying means that magnetically applies the first sliding resistance in-between the holding arm 21 serving as the moving member and the guide rail 25. The carriage 13 is provided with, as the second sliding resistance applying means, an electromagnet 26 that magnetically applies the second sliding resistance in-between the carriage and the holding arm 21.

Figure 2:
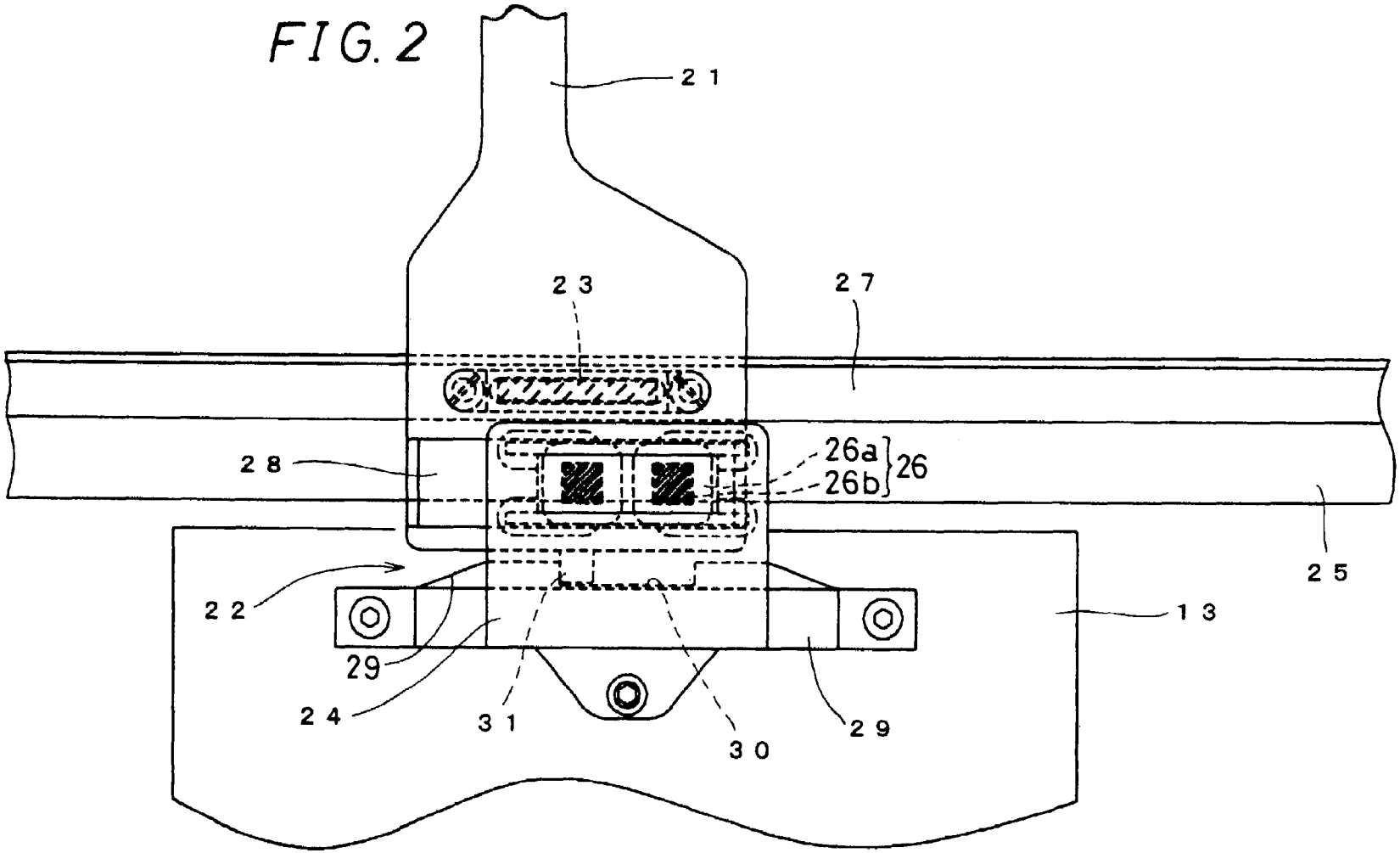
FIG. 2 is a plan view showing a configuration of a part associated with a permanent magnet 23 and an electromagnet 26 of FIG. 1.
Figure 3:
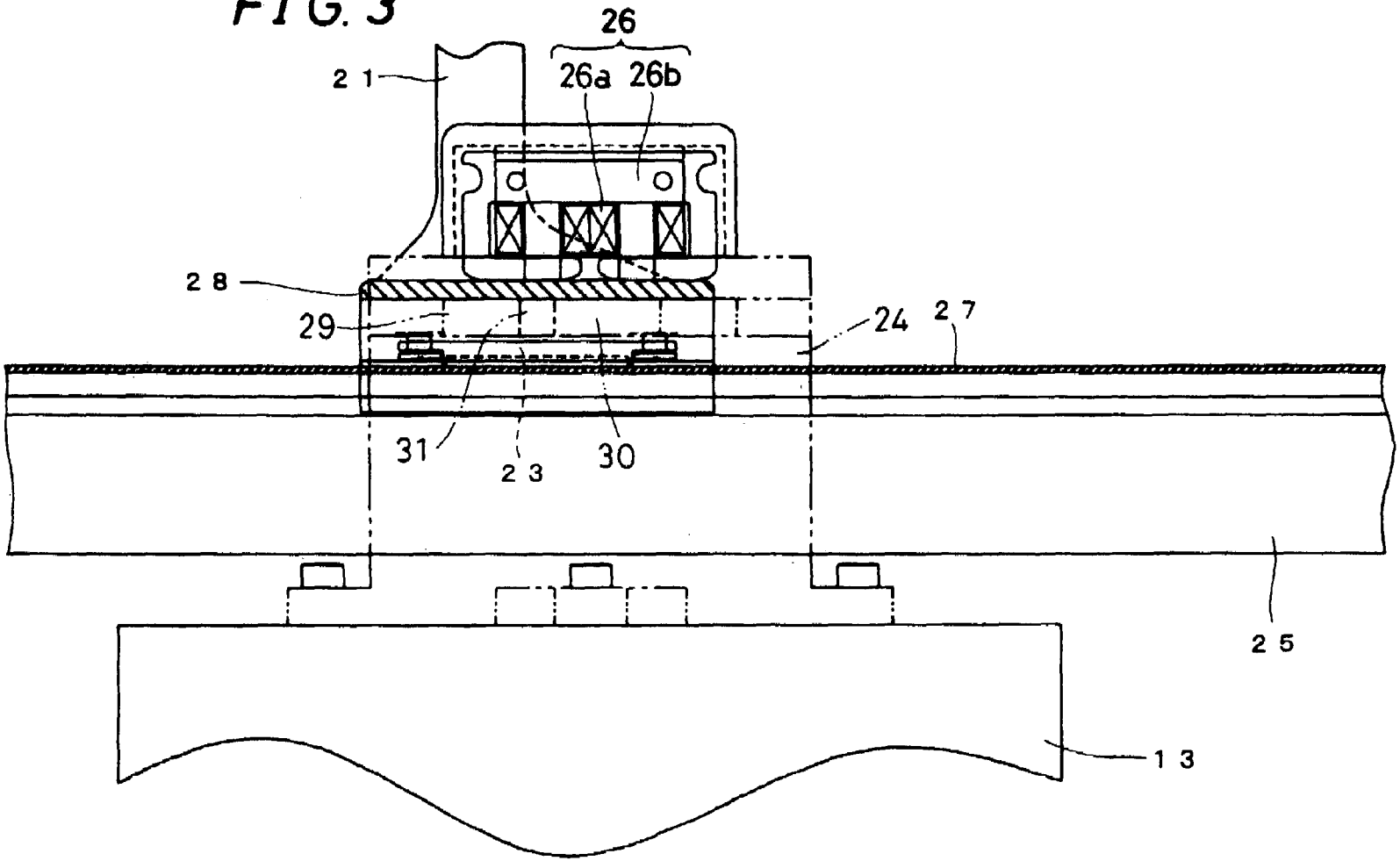
FIG. 3 is a front view showing a configuration of a part associated with the permanent magnet 23 and the electromagnet 26 of FIG. 1.

FIGS. 2 and 3 show a configuration of a part associated with the permanent magnet 23 and the electromagnet 26 of FIG. 1. FIG. 2 shows in top view, and FIG. 3 shows in front view. The guide rail 25 is formed using a nonferromagnetic metal material, such as aluminum (Al), for the purpose of weight reduction. The electromagnet 26 is formed with a coil **26*a* wound around a yoke 26*b* made of a ferromagnetic material. A metal band 27 made of steel, which is a ferromagnetic metal, is placed on the surface of the guide rail 25. The metal band 27 is magnetically attracted toward the permanent magnet 23, and generates the first sliding resistance. It is also possible to form the entire guide rail 25** by using a ferromagnetic metal material, such as steel.

The holding arm 21 is formed using a light metal material, such as aluminum, or a synthetic resin material, for the purpose of weight reduction. On the base of the holding arm 21, together with the permanent magnet 23, a steel band 28 is also placed. The steel band 28 is disposed in a position to confront the connecting portion 24 of the carriage 13. A bringing member 29 is disposed to the connecting portion 24 of the carriage 13, and arranged so as to face the holding arm 21. The bringing member 29 is provided with a bringing recessed portion 30. A bringing pin 31 that appears from and disappears to the side of the holding arm 21 can engage with the bringing recessed portion 30.

Figure 4:
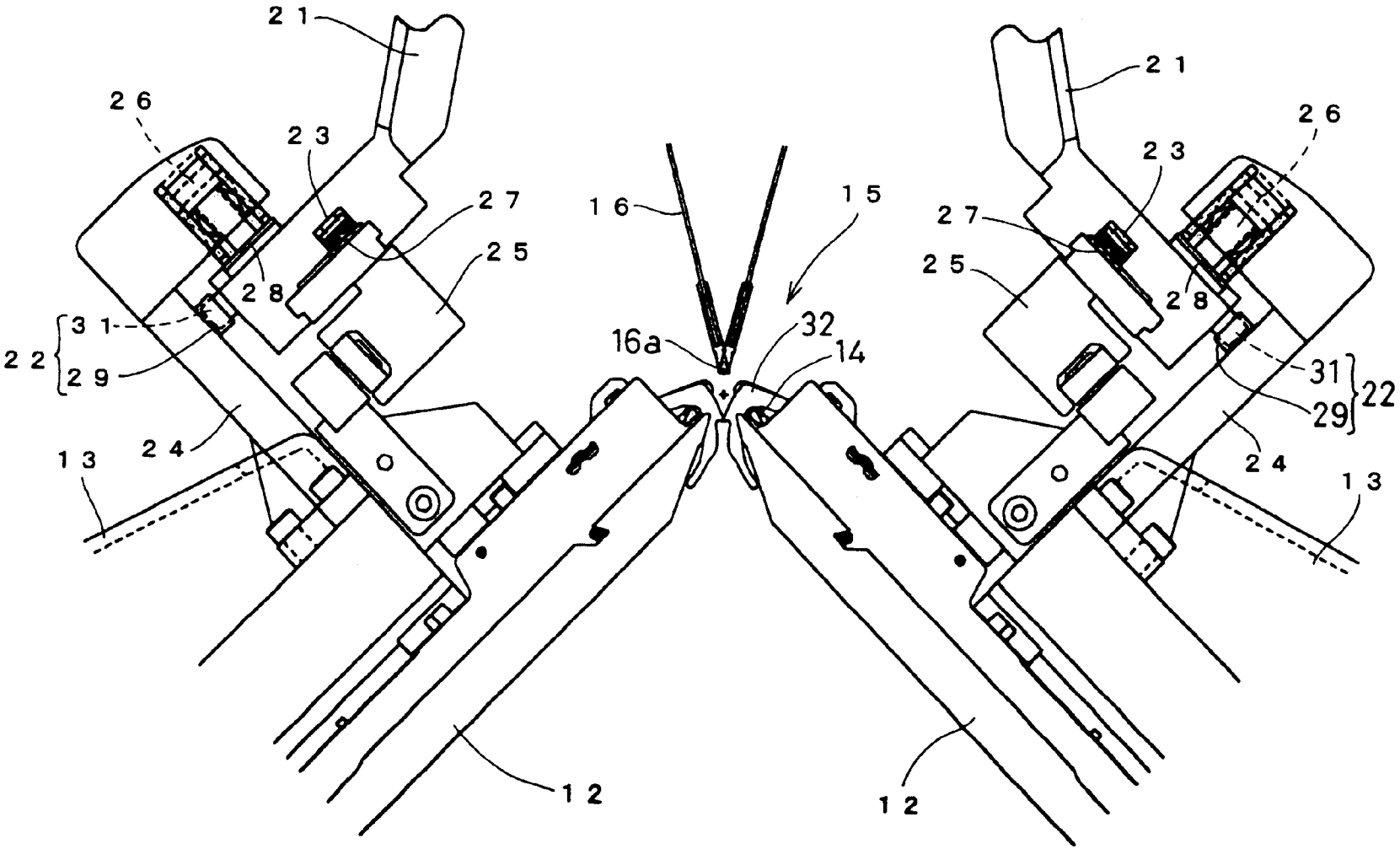
FIG. 4 is a sectional side view of a needle bed gap 15 and the surrounding area in the weft knitting machine 11 of FIG. 1.

FIG. 4 shows a configuration in cross section view of the needle bed gap 15 and the surrounding area in the weft knitting machine 11 of FIG. 1. Each of the carriages 13 traveling along the longitudinal direction of the front and back needle beds 12 can bring the holding arm 21, and is provided with the bringing state switching mechanism 22, the permanent magnet 23, the connecting portion 24, the guide rail 25, the electromagnet 26, the metal band 27, the steel band 28, the bringing member 29 and the bringing pin 31. To the needle bed gap 15, not only the tip of the knitting needle 14 advances from each of the needle beds 12, but also a member used for knitting a fabric, such as a sinker 42, advances from each of the needle beds 12. The yarn feeder 16 can be attached to and detached from the holding arm 21 on the upper end side not shown in the drawing. The yarn feeder 16 placed on the holding arm 21 has a yarn feeding port **16*a* at the lower end, and can feed the knitting yarn to the knitting needle 14 that advances to the needle bed gap 15**.

Figure 5:
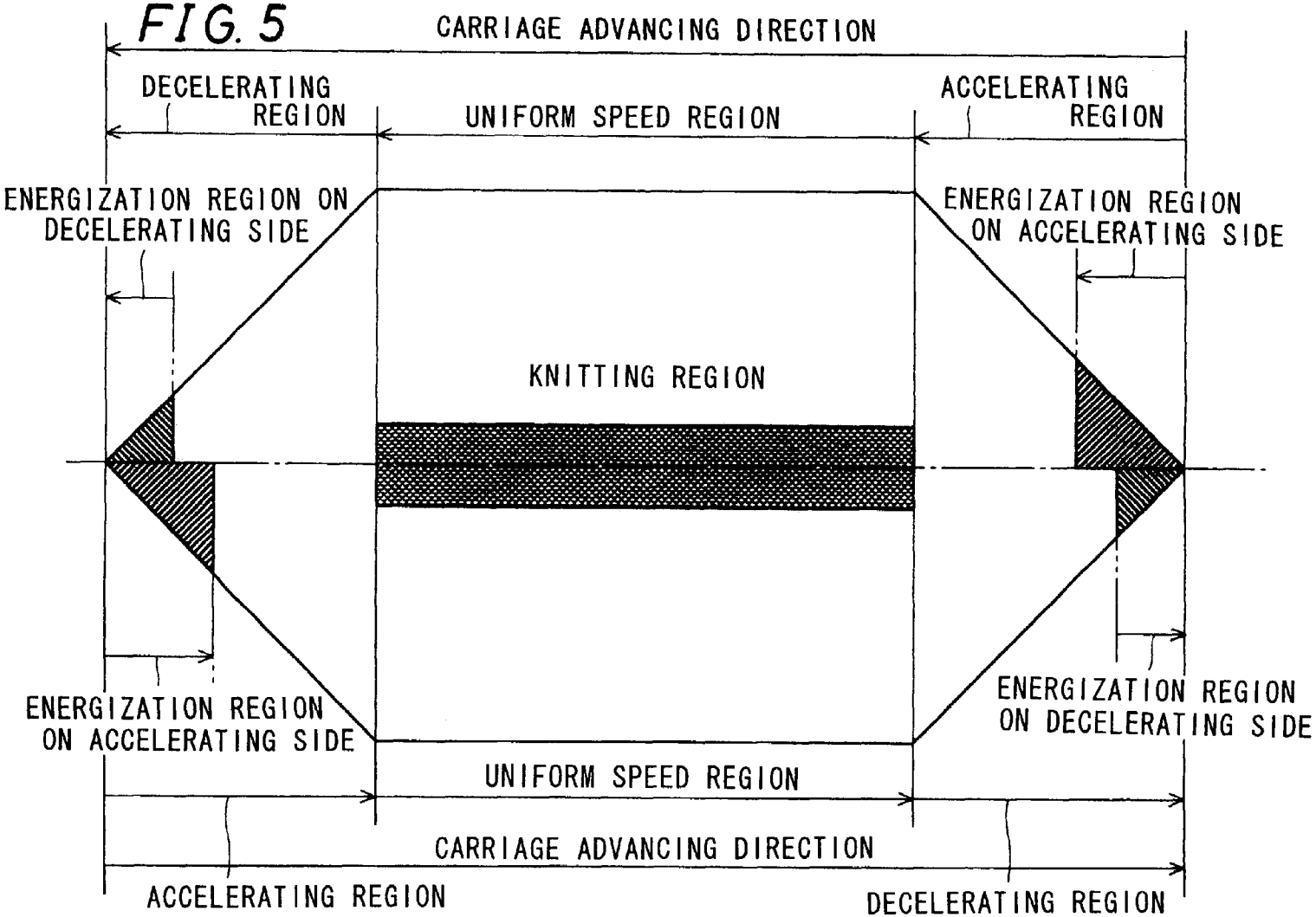
FIG. 5 is a graph schematically showing a relationship between control of a moving state of a carriage 13 in the weft knitting machine 11 of FIG. 1 and electromagnetic brake by energizing the electromagnet 26.

FIG. 5 schematically shows a relationship between control of a moving state of the carriage 13 and electromagnetic brake by energizing the electromagnet 26. Since the carriage 13 reciprocates along the longitudinal direction of the needle bed 12, an advancing direction is switched between two of rightward and leftward directions alternately. In the control of the moving state of the carriage 13, an accelerating region in which a speed is increased from a stationary state, a uniform speed region in which the carriage advances at constant speed, and a decelerating region in which the speed is decreased to a stop are provided for each of the advancing directions. A knitting region to execute knitting of a fabric is provided so as to correspond to the uniform speed region in chief. The knitting region may also be set so as to overlap to the accelerating region and the decelerating region. The electromagnetic brake by the electromagnet 26 is made to act at the end of the decelerating region as shown by hatch that slopes to the right. This is for securely stopping the holding arm 21 after the carriage 13 stops. In the accelerating region, the electromagnetic brake is made to act at the beginning. This is for making the second sliding resistance act during a period before the bringing pin 31 abuts against an end portion of the bringing recessed portion 30.

Figure 6:
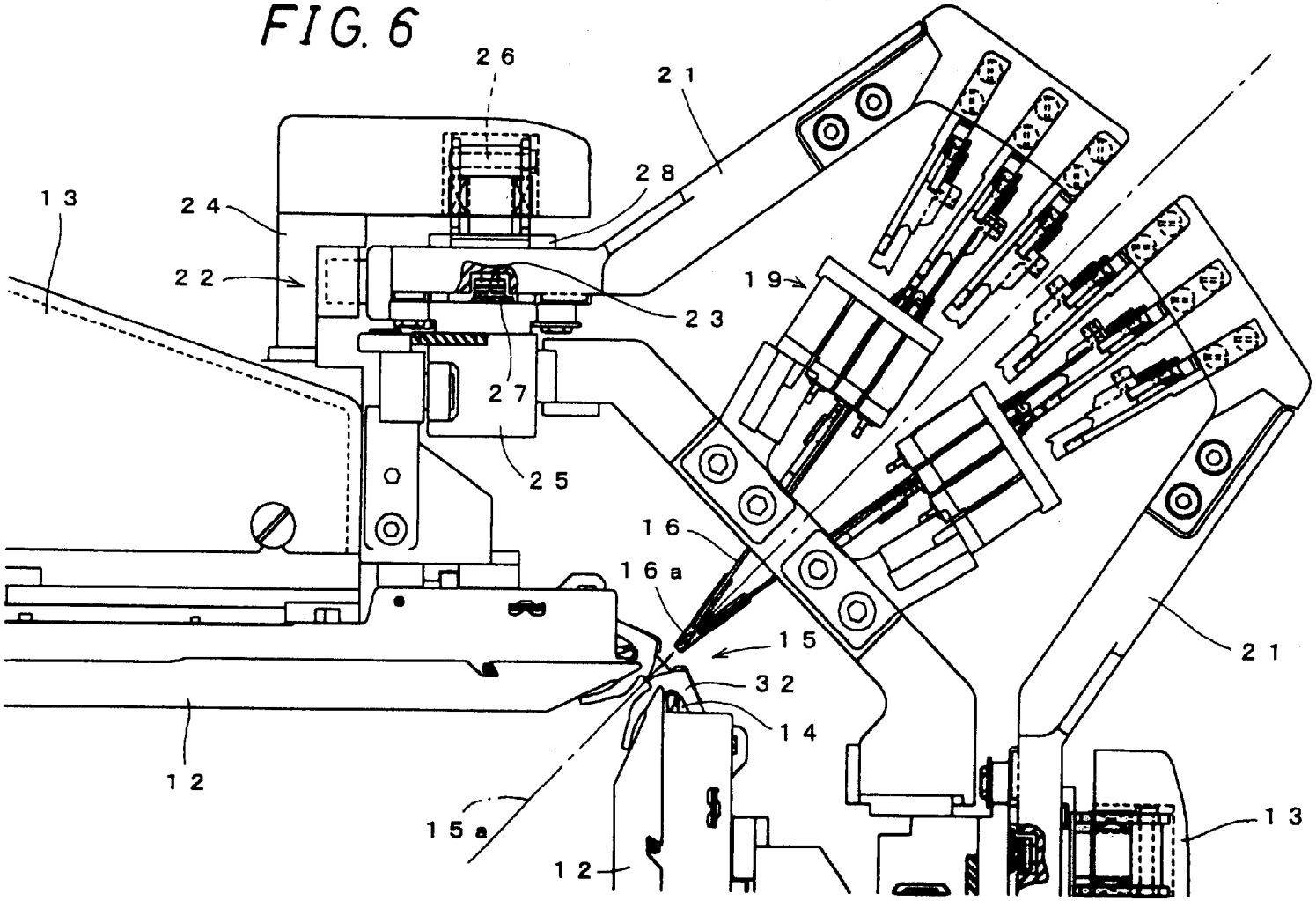
FIG. 6 is a right side view showing a state in which the carriage 13 has moved to a position of a stopping device 19 that halts a yarn feeder 16 of FIG. 1.

FIG. 6 shows a state where the carriage 13 has moved to a position of the stopping device 19 that halts the yarn feeders 16 in side view. Although a configuration on the side of one needle bed 12 is described more for the convenience of an explanation, there is the same configuration also on the side of the other needle bed 12 with respect to a central face 15*a* of the needle bed gap 15. Each of the holding arms 21 is capable of holding up to three yarn feeders 16. However, since the yarn feeding ports 16*a* at the lower ends of the yarn feeders 16 feed the knitting yarn from almost the same positions on the needle bed gap 15, it is impossible to place the plurality of yarn feeders 16 on the holding arms 21 at the same time. The stopping devices 19 that halt the yarn feeders 16 are arranged with the positions out of line in the longitudinal direction of the needle bed 12, it is possible to halt the plurality of yarn feeders 16 at the same time in a manner that the yarn feeding ports 16*a* do not interfere with each other.

As described above, in the present embodiment, the weft knitting machine 11 comprises, as an apparatus for applying sliding resistance for a weft knitting machine, the guide rail 25, the bringing state switching mechanism 22 serving as the connection switching means, the permanent magnet 23 serving as the first sliding resistance applying means, and the electromagnet 26 serving as the second sliding resistance applying means, for the purpose of applying sliding resistance to the holding arm 21 serving as the moving member that is brought by the carriage 13 and slides in the longitudinal direction of the needle bed 12. The guide rail 25 is constructed in parallel to the longitudinal direction of the needle bed 12, and the holding arm 21 can slide and move thereon. The bringing state switching mechanism 22 is capable of switching to either a state where the holding arm 21 and the carriage 13 are connected and the carriage 13 brings the holding arm 21, or a state where the connection is released and the carriage 13 does not bring the holding arm 21. The permanent magnet 23 applies the first sliding resistance in-between the guide rail 25 and the holding arm 21. The electromagnet 26 applies the second sliding resistance in-between the holding arm 21 and the carriage 13, and makes the second sliding resistance smaller than the first sliding resistance at least when the carriage 13 reverses a moving direction. When the carriage 13 stops moving, the holding arm 21 persists in moving through inertia. Since the first sliding resistance is applied in-between the holding arm 21 and the stationary guide rail 25, and the second sliding resistance is applied in-between the holding arm and the carriage 13 that has stopped moving, sliding resistance that is the sum of the first sliding resistance and the second sliding resistance acts on the stationary parts, and it is possible to stop promptly.

Since the second sliding resistance does not act when the carriage 13 brings the holding arm 21, a load on movement of the carriage 13 is only the first sliding resistance of the two sliding resistances, and hence, it is possible to decrease the load. When the carriage 13 starts bringing the holding arm 21, a direction of the first sliding resistance that acts between the holding arm 21 and the guide rail 25, and a direction of the second sliding resistance between the carriage 13 having started movement and the holding arm 21 become the opposite, and the holding arm 21 is substantially held back on the guide rail 25 due to a difference between the first sliding resistance and the second sliding resistance, with the result that it is possible to decrease the sliding resistance that acts when bringing is started, and reduce occurrence of an impact and a noise.

Further, the holding arm 21 serving as the moving member is provided with the plurality of holders 18, each of which holds the yarn feeder 16 having the yarn feeding port 16*a* for feeding the knitting yarn at the tip, in a position where the yarn feeding port 16*a* faces the knitting needle 14 in knitting operation, so that the mass is larger than in the case of holding the yarn feeder alone, and inertia at the time of a stop is also large. However, since it is possible to increase the sliding resistance that acts when the holding arm 21 stops at the end of a bringing movement, it is possible to securely stop. Since it is possible to decrease substantial sliding resistance to the guide rail 25 when the carriage 13 converts a direction, it is possible to reduce occurrence of an impact and a noise.

That is to say, it is possible to make the second sliding resistance that can be controlled larger than the first sliding resistance, as well as gradually change. For example, when stopping the holding arm 21 serving as the moving member, it is possible to instantly stop by making the second sliding resistance larger than the first sliding resistance. Moreover, it is possible to gradually increase the second sliding resistance when the carriage 13 reverses for reciprocating in the decelerating region, and gradually decrease in the accelerating region, thereby softening an impact at the abutting time when the bringing pin 31 serving as the controlling member and the bringing recessed portion 30 serving as the engagement place for bringing of the bringing member 29 start engaging each other.

In the decelerating region, when the carriage 13 stops, it is also possible to control so as to: cause the holding arm 21 serving as the moving member to overrun; and gradually increase the second sliding resistance so that a position of an end portion of the bringing recessed portion 30 against which the bringing pin 31 abuts is switched from the side against which the bringing pin 31 abuts to an end portion on the opposite side before the carriage 13 stops. When the carriage 13 reverses the moving direction and starts movement next, the carriage can start bringing the holding arm 21 in a state where the bringing pin 31 abuts against the end portion of the bringing recessed portion 30 at a speed of 0, so that it is possible to avoid an impact caused by abutting from a state where there is a distance between the bringing pin 31 and the end portion. In a case where there is a distance to the end portion of the bringing recessed portion 30 against which the bringing pin 31 is going to abut, it is possible to avoid occurrence of an impact, by controlling so as to make the second sliding resistance larger than the first sliding resistance and start bringing the holding arm 21 at the beginning of the accelerating region where the carriage 13 starts moving, and decrease the second sliding resistance so that the end portion of the bringing recessed portion 30 gradually abuts against the bringing pin 31 before the knitting region.

It is also possible to provide a second permanent magnet which generates magnetic attraction and applies the second sliding resistance smaller than the first sliding resistance, as the second sliding resistance applying means. Since the sliding resistances are applied by the first and second permanent magnets, it is possible to apply the first sliding resistance and the second sliding resistance in a stable manner at all times. Since the second sliding resistance is smaller than the first sliding resistance, when the carriage 13 reverses the moving direction, it is possible to keep the holding arm 21 stationary on the guide rail 25 until bringing by the holding arm 21 starts, and cause only the carriage 13 to move.

Figure 7:
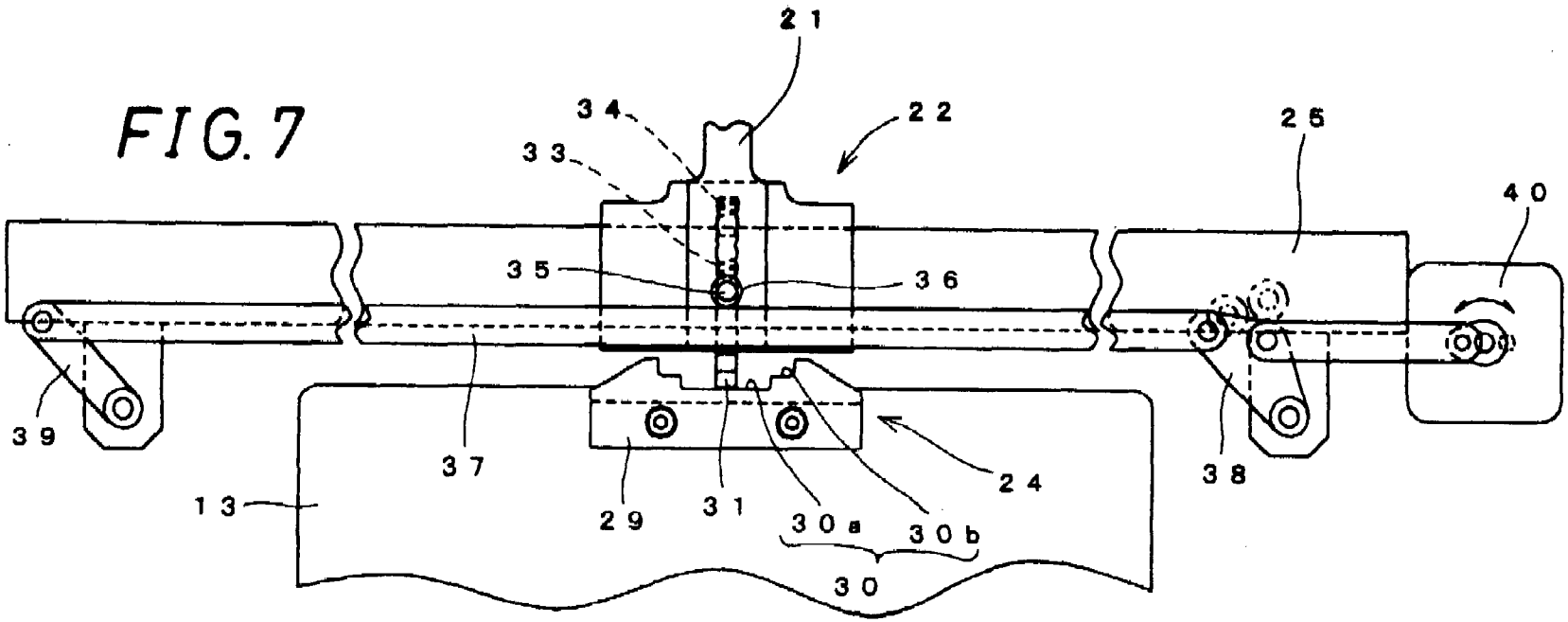
FIG. 7 is a partial front view schematically showing a configuration associated with a bringing state switching mechanism 22 and a connecting portion 24 of FIG. 1.

FIG. 7 schematically shows a configuration associated with the bringing state switching mechanism 22 and the connecting portion 24 of FIG. 1. The bringing state switching mechanism 22 is provided with the bringing pin 31 that is a projecting member, a projection amount of which toward the carriage 13 can be changed. The bringing pin 31 is stored in a pin storage hole 33, and biased by a spring 34 in a direction to project toward the carriage 13 from the pin storage hole 33. A roller support pin 35 is disposed around a position where the bringing pin 31 is biased by the spring 34, and a roller 36 is disposed to the tip of the roller support pin 35. The roller 36 abuts against an operation bar 37. The operation bar 37 forms a parallelogram link together with a driving link piece 38 and a driven link piece 39 so as to become parallel to the guide rail 25, and keeps parallel to the longitudinal direction of the needle bed 12, that is, a direction of the guide rail 25 at all times. The parallelogram link receives a driving force by a motor 40, and the operation bar 37 can make displacement so as to approach or leave the carriage 13.

The connecting portion 24 on the side of the carriage 13 includes the bringing member 29. The bringing member 29 is provided with the bringing recessed portion 30 composed of two steps of a deep part 30*a* and a shallow part 30*b*. The deep part 30*a* of the bringing recessed portion 30 is for normal knitting, and shorter in length as compared with the shallow part 30*b* for plaiting knitting. In a case where the bringing pin 31 is not allowed to project, the bringing pin 31 does not engage with the connecting member 29, so that the carriage 13 can move without bringing the holding arm 21. When the bringing state switching mechanism 22 switches to the state where the holding arm 21 is not brought by the carriage 13, the carriage 13 can move with the holding arm 21 and the yarn feeder 16 separated therefrom, the mass accompanying the movement is reduced, and a prompt movement becomes possible.

That is to say, the bringing state switching mechanism 22, which serves as the connection switching means, has: the controlling member that is disposed to one of the carriage 13 and the holding arm 21 serving as the moving member, that is the bringing pin 31 capable of appearing and disappearing, and that is capable of controlling a deformation state thereof; and the bringing member 29 that is disposed to the other of the carriage 13 and the holding arm 21, and that has the bringing recessed portion 30 as the engagement place for bringing that can engage with the bringing pin 31 when the controlling member is in a predetermined deformation state, namely, when the bringing pin 31 is in a projecting state, with the result that when the carriage 13 converts the direction, it is possible to reduce occurrence of an impact and a noise accompanying conversion of a position where the bringing pin 31 and the bringing recessed portion 29 abuts against each other, by decreasing substantial sliding resistance of the holding arm 21 to the guide rail 25.

The controlling member is not limited to the bringing pin 31 capable of appearing and disappearing, and even if the controlling member is a swinging lever or the like, it is possible to achieve a function as the connection switching means, by using a bringing member in which an engagement place for bringing is disposed so as to match. The engagement place for bringing is not limited to a recessed portion like the bringing recessed portion 30, and even if the engagement place for bringing is a projection, it is also possible to achieve the function.

Figure 8:
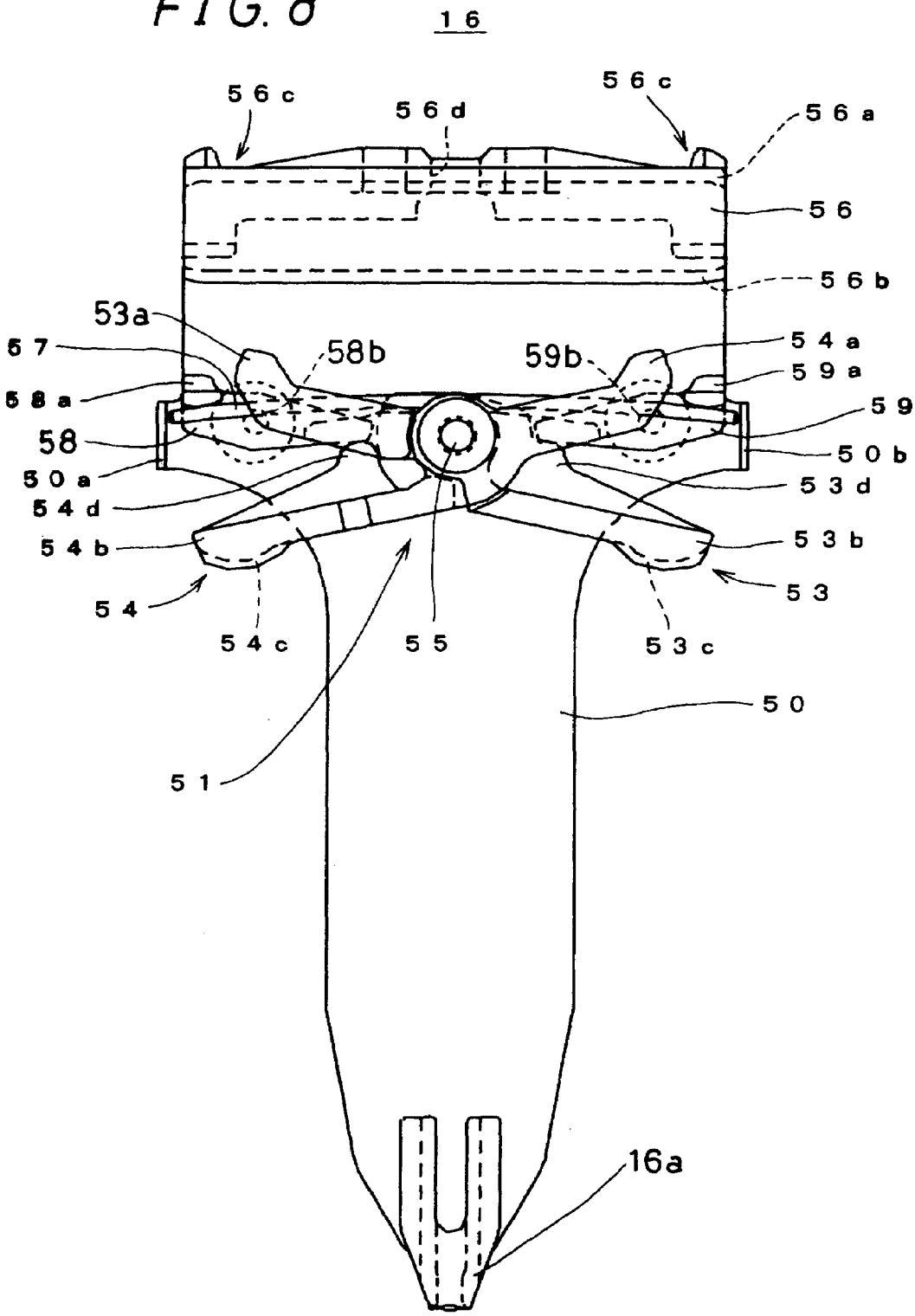
FIG. 8 is a front view showing a configuration of the yarn feeder 16 of FIG. 1.

FIG. 8 shows a configuration of the yarn feeder 16 shown in FIG. 1. The yarn feeder 16 is provided with a locking mechanism 51 on the proximal end side of a rod-like base 50, and provided with the yarn feeding port 16*a* on the tip side. The locking mechanism 51 is provided with a pair of levers 53 and 54 and a swing shaft 55. At the end of the proximal end portion of the base 50, a guide member 56 is fixed. The guide member 56 is provided with grooves 56*a* and 56*b* on an upper side and a lower side thereof, respectively, and also provided with a recessed portion 56*c* for being locked by the stopping mechanism 11 on an upper portion thereof.

The pair of levers 53 and 54 of the locking mechanism 51 intersect at the midpoints so as to be X-shaped, and can make swing displacement about the swing shaft 55 inserted into the intersection, respectively. On one end sides 53*a* and 54*a* of the respective levers 53 and 54, projections that can be locked into the holder 18 are formed. It is possible to make an external force act on the other end sides 53*b* and 54*b* of the respective levers 53 and 54. On the other end sides 53*b* and 54*b*, grooves 53*a* and 54*c* are formed at portions subjected to application of the external force, respectively. By applying the external force in-between the other end sides 53*b* and 54*b* of the pair of levers 53 and 54, it is possible to open and close the one end sides 53*a* and 54*a*, and switch between a locked state and an unlocked state with respect to the holder 18.

A wire spring 57 is also arranged adjacent to the locking mechanism 51. The wire spring 57 is made of a material having elasticity, such as piano wire, both ends thereof are guided by projections 58*a* and 59*a* of a pair of swing pieces 58 and 59 disposed on both sides in the width direction of the base 50 and bent portions 50*a* and 50*b* of the base 50, and a middle portion thereof is curved so that both the ends spring back by using the intersection of the levers 53 and 54 as a fulcrum. Swing fulcrums 58*b* and 59*b* are disposed to the midpoints of the swing pieces 58 and 59, respectively. The levers 53 and 54 of the locking mechanism 51 are also provided with pressuring portions 53*d* and 54*d* that receive a pressing force from the wire spring 57 between the swing shaft 55 and the other end sides 53*b* and 54*b*, respectively. When an external force acts on the other end sides 53*b* and 54*b* of the levers 53 and 54, the levers 53 and 54 make swing displacement around the swing shaft 55, the pressuring portions 53*d* and 54*d* of the levers 53 and 54 press the swing pieces 58 and 59, and the swing pieces 58 and 59 swing on the swing fulcrums 58*b* and 59*b*, thereby making the wire spring 57 curved. Since the other end sides 53*b* and 54*b* of the levers 53 and 54 of the locking mechanism 21 serving as locking means are spring-biased by the wire spring 57 serving as biasing means so that the one end sides 53*a* and 53*b* of the levers 53 and 54 approach each other, it is possible to keep the locked state by the spring bias, in the case of letting the one end sides 53*a* and 54*a* of the levers 53 and 54 locked into the holder 18 in the closing direction.

Figure 9:
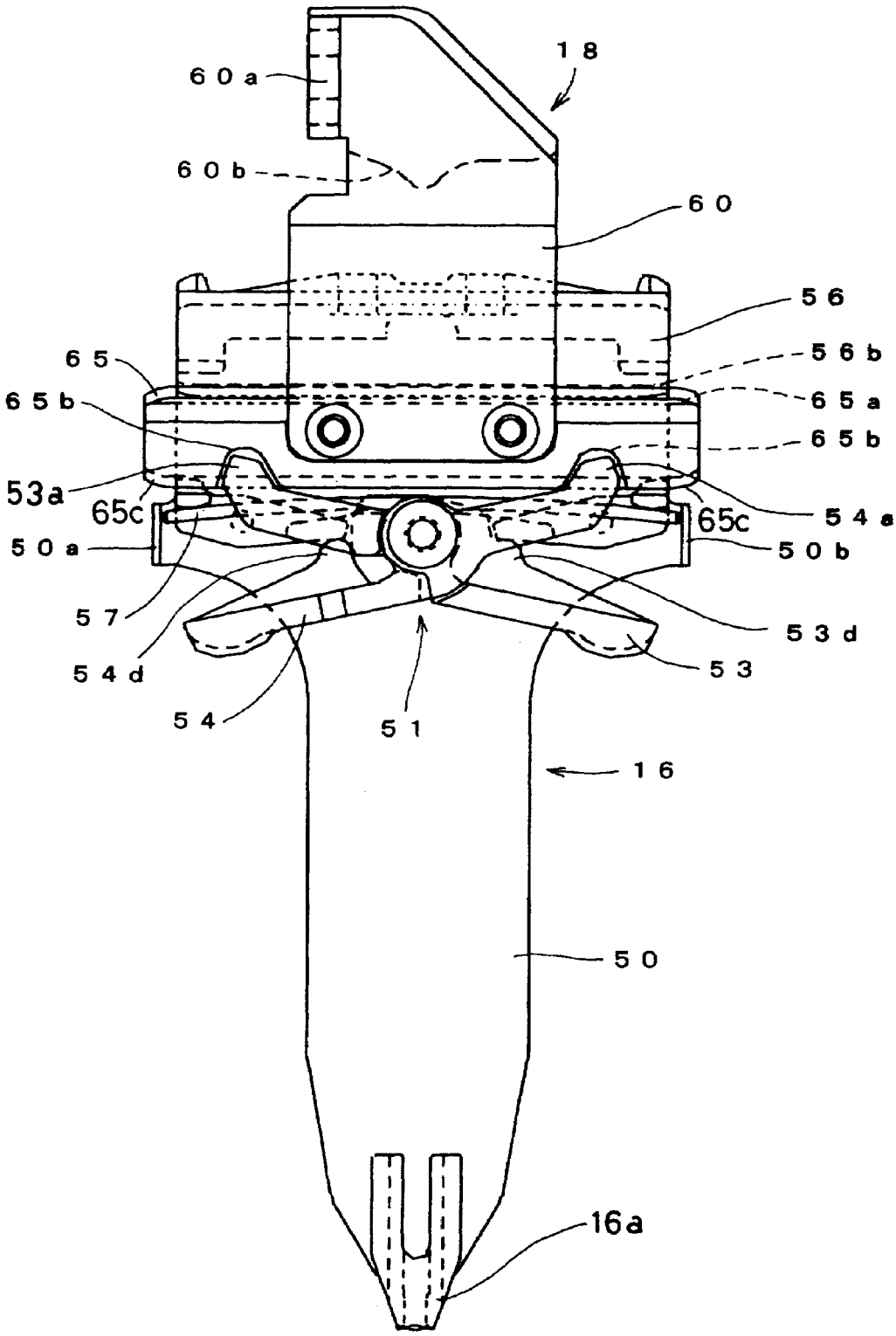
FIG. 9 is a front view showing a state in which the yarn feeder 16 of FIG. 1 is locked into a holder 18.

FIG. 9 shows a state in which the yarn feeder 16 is locked into the holder 18. The holder 18 includes an attachment member 60 and a support member 65. The attachment member 60 has an attachment portion 60*a* for attachment to the holding arm 21 of FIG. 1, and a cam groove 60*b* for releasing lock into the recessed portion 56*c* of the guide member 56 of the yarn feeder 16. The support member 65 has a projected rim 65*a* that fits into the groove 56*b* on the lower side of the guide member 56, recessed portions 65*b* into which the one end sides 53*a* and 54*a* of the levers 53 and 54 of the yarn feeder 16 are locked, and a pressing portion 65*c* for causing a switching mechanism disposed to the stopping device 19 to operate. The yarn feeder 16 can maintain a state in which the one end sides 53*a* and 54*a* of the pair of levers 53 and 54 of the locking mechanism 51 are locked into the recessed portions 65*b* of the support member 65 of the holder 18, owing to a bias by a press from the spring wire 57 to pressuring portions 53*d* and 54*d* of the levers 53 and 54.

Figure 10:
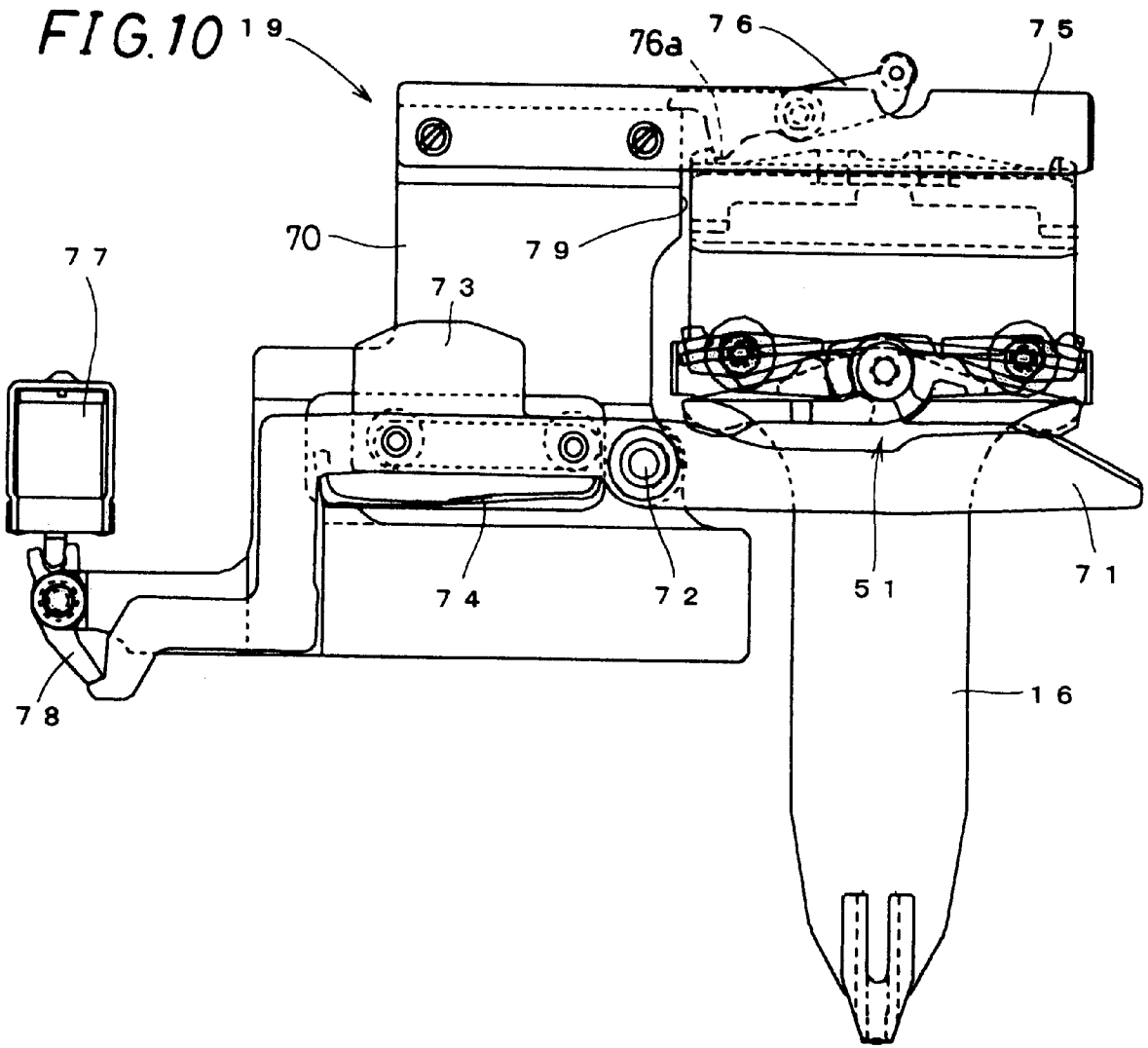
FIG. 10 is a front view showing a state in which the yarn feeder 16 of FIG. 1 is halted by the stopping device 19.

FIG. 10 shows a state in which the yarn feeder 16 is halted by the stopping device 19. In the stopping device 19, from the lower portion of a frame 70 installed upright from the needle bed 12 of FIG. 1, a halt control lever 71 is projected along a path where the carriage 13 reaches. The halt control lever 71 can make swing displacement about a swing shaft 72 disposed to the midpoint. One side of the halt control lever 71 across the swing shaft 72 can slidingly contact the other end sides 53*b* and 54*b* of the levers 53 and 54 of the locking mechanism 51 of the yarn feeder 16, from below. A pressed member 73 is attached on the other side of the halt control lever 71 across the swing shaft 72. The pressed member 73 is biased by a spring 74 so as to project upward. A bias by the spring 74 also acts on the halt control lever 71 through the pressed member 73. From the upper portion of the frame 70, in almost parallel to the halt control lever 71, a stopping lever 75 projects so as to extend along a traveling path of the carriage 13. A stopper nail 76 is disposed in the middle of the stopping lever 75, and a nail portion 76*a* on one end side thereof can be locked into the recessed portion 56*c* of the guide member 56 of the yarn feeder 16. The stopper nail 76 makes swing displacement by using a swing shaft 76*c* at the midpoint as a fulcrum as a roller 76*b* on the other end thereof is guided in the cam groove 60*b* disposed to the attachment member 60 of the holder 18, and lock of the yarn feeder 16 by the nail portion 76*a* on the one end side of the stopper nail 76 is released while the holder 18 is passing by the stopping device 19.

A lock piece 78, an inclination of which is changed by an operation piece 77*a* of a bistable-type solenoid 77, abuts against the end portion on the other side across the swing shaft 72 of the halt control lever 71, the pressed member 73 is pressed, the halt control lever 71 presses the other end sides 53*b* and 54*b* of the levers 53 and 54 of the locking mechanism 51 and can be locked in a state where the locking mechanism 51 shifts to the unlocked state. The solenoid 77 can be excited by the control unit 20 of FIG. 1. The locked state of the halt control lever 71 can be released by exciting the solenoid 77 in the opposite direction and causing the lock piece 78 to make swing displacement in the opposite direction.

In the stopping device 19, lock by the stopper nail 76 into the yarn-feeder 16 is released by the cam groove 60*b*, but it is possible to hinder movement of the yarn feeder 16 by a stopper portion 79 when the pressing portion 65*c* of the holder 18 moves to a position to press the pressed member 73.

Figure 11:
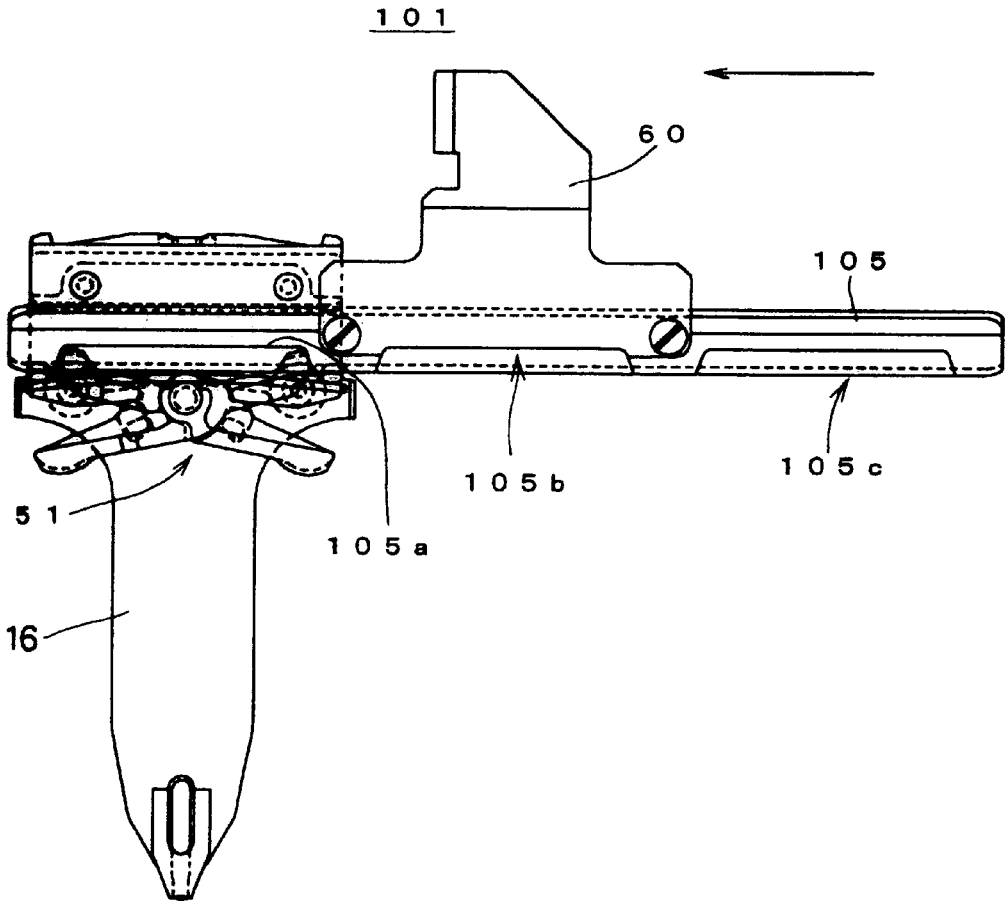
FIG. 11 is a front view showing another embodiment of a holder 101 that can be placed on a holding arm 21 of FIG. 1.

FIG. 11 shows another embodiment of a holder 101 that can be placed on the holding arm 21 of FIG. 1. A support member 105 of the holder 101 has recessed portions 105*a*, 105*b* and 105*c* at three places, and can selectively lock the yarn feeder 16. In the case of locking the yarn feeder 16 into the recessed portion 105*b* in the center, it is possible to use for normal knitting in the same manner as the holder 18 of FIG. 8. It is possible to use the left and right recessed portions 105*a* and 105*c* disposed to the support member 105, when displacing a yarn feeding position of the yarn feeder 16 from timing that the knitting needle 14 is caused to advance to the needle bed gap 15 by the knitting cam, and executing inlay knitting, for example. In the case of locking the yarn feeder 16 into the recessed portion 105*a* on the left, it is possible to feed the yarn in advance when the carriage 13 advances to the left. In the case of locking the yarn feeder 16 into the recessed portion 105*c* on the right, it is possible to feed the yarn in advance when the carriage 13 advances to the right.

Figure 12:
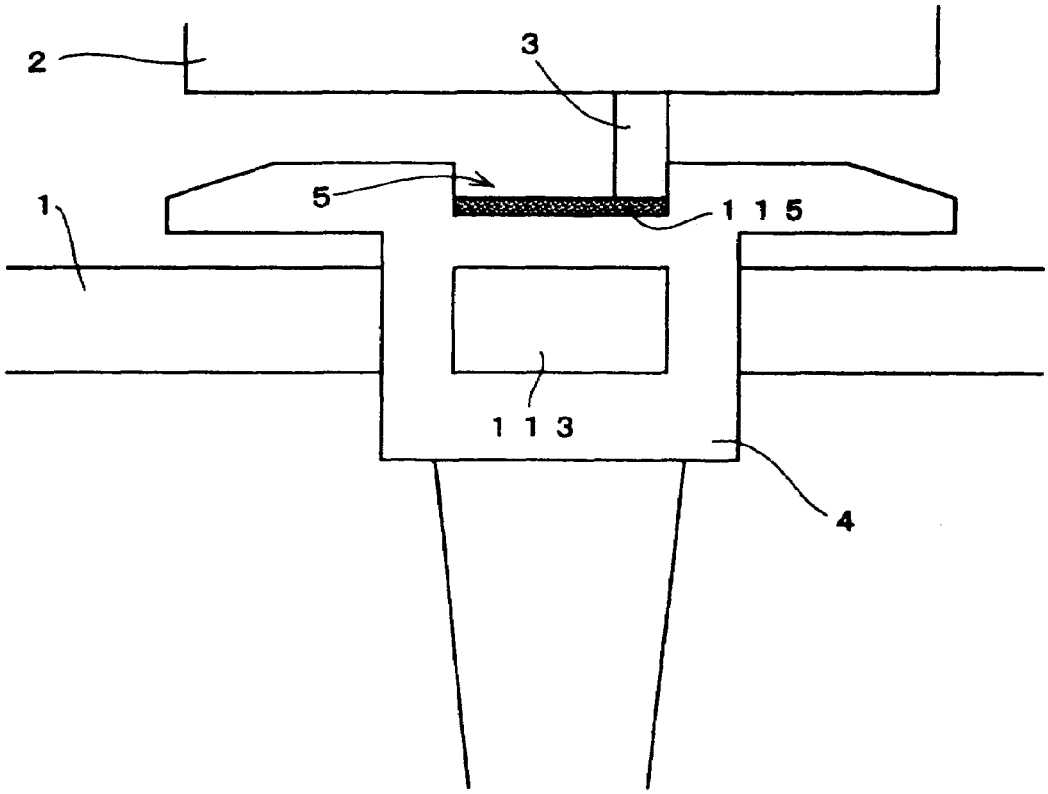
FIG. 12 is a partial front view showing still another embodiment of the invention.
Figure 15:
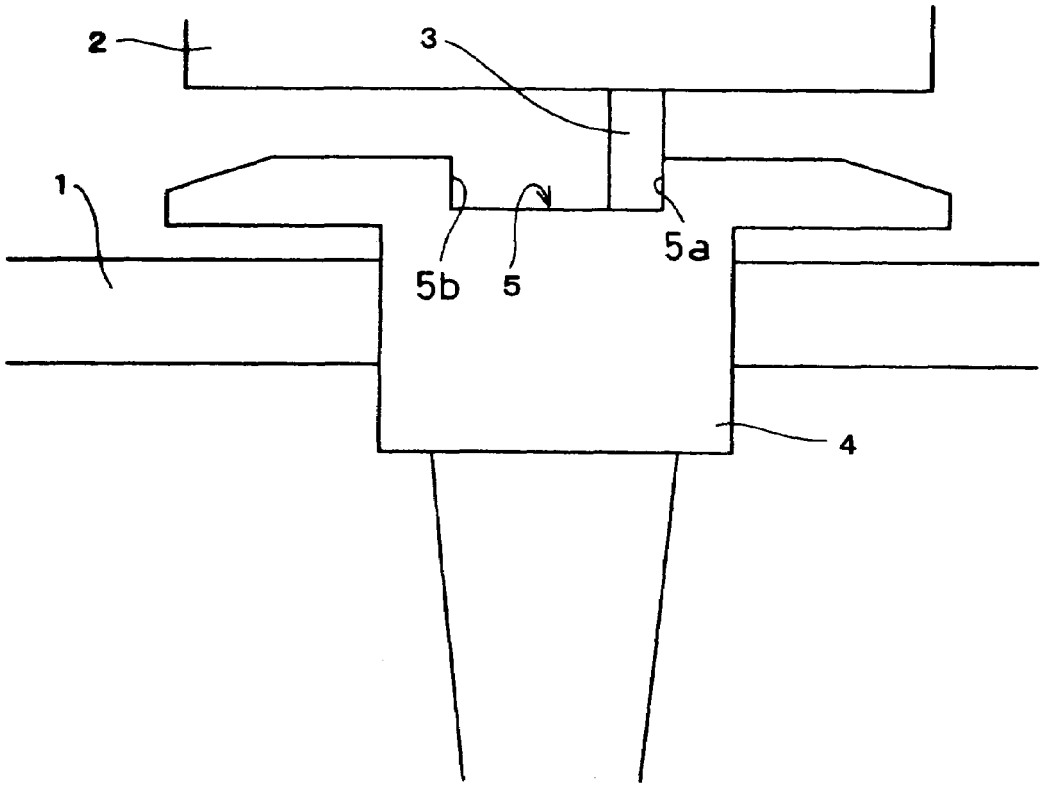
FIG. 15 is a partial front view showing a conventional bringing state of a carrier.

FIG. 12 shows, as another embodiment of the invention, a configuration to apply the first sliding resistance and the second sliding resistance to the carrier 4 moving along the yarn guide rail 1 as shown in FIG. 15. In the present embodiment, parts corresponding to those of the prior art of FIG. 15 and the embodiments shown in FIGS. 1 to 11 will be denoted by the same reference numerals, and a duplicated description will be omitted. For the purpose of application of the first sliding resistance when the carrier 4 serving as the moving member moves along the yarn guide rail 1 serving as the guide rail, a permanent magnet 113 is disposed. For the purpose of application of the second sliding resistance in-between the bridge 2 linked with the carriage and the carrier 4, a sliding member 115 is arranged in the bringing recessed portion 5. When the bringing pin 3 projects and engages with the bringing recessed portion 5, the tip of the bringing pin 3 slidingly contacts the surface of the sliding member 115, and sliding resistance by friction is generated. It is possible to regulate the magnitude of the sliding resistance by a pressing force of the bringing pin 3 to the sliding member 115. It is also possible to dispose this configuration for application of the sliding resistance to the bringing recessed portion 29 shown in FIG. 2. Moreover, it is also possible to dispose a permanent magnet and an electromagnet on the side of the bridge 2, and electromagnetically apply the second sliding resistance.

Figure 13:
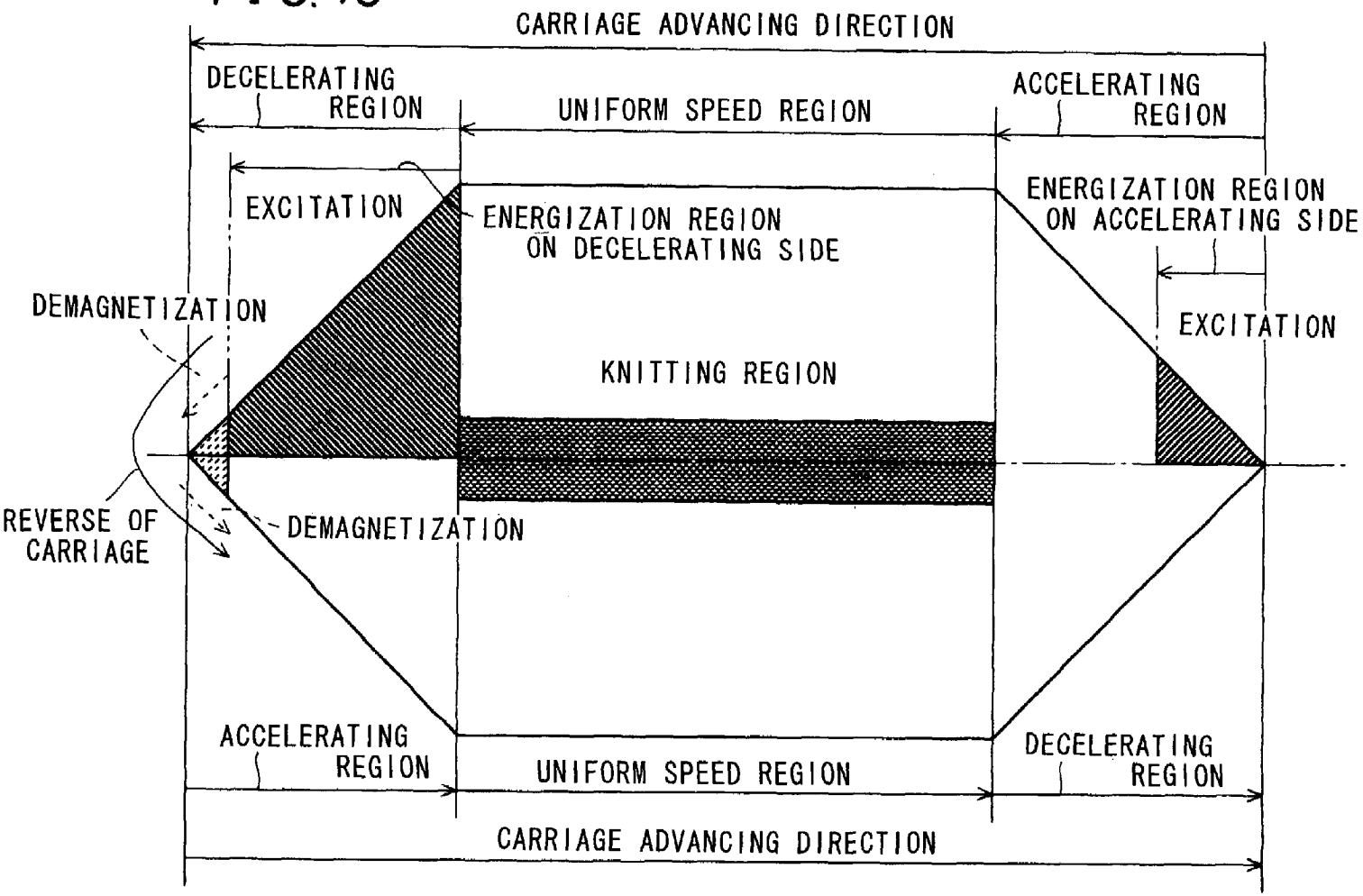
FIG. 13 is a graph schematically showing a relationship between control of the moving state of the carriage 13 when the carriage 13 reverses with the holding arm 21 separated and control of an energized state of the electromagnet 26 in still another embodiment of the invention.

FIG. 13 schematically shows, as still another embodiment of the invention, a relationship between control of the moving state of the carriage 13 when the carriage 13 leaves the holding arm 21 brought thereby and control of the electromagnet 26. In the present embodiment, a fabric is knitted in the same configuration as in the embodiment of FIG. 1 basically. In the present embodiment, parts corresponding to those of the embodiment of FIG. 1 will be denoted by the same reference numerals, and a duplicated description will be omitted. Control executed when the carriage 13 brings the holding arm 21 is the same as in FIG. 5. In the present embodiment, when the carriage reverses, the electromagnet 28 is demagnetized as shown by a broken line. Although such a case will be described that the carriage 13 brings the holding arm 21 when moving leftward in the drawing and leaves the holding arm 21 when reversing for movement rightward, it is needless to say that the same control may be executed when the carriage reverses from a rightward movement to a leftward movement. Moreover, it is needless to say that when the carriage 13 brings or leaves the holding arm 21, the motor 40 is controlled and the bringing state switching mechanism 22 is switched at the same time.

In the control shown in FIG. 5, in order that the holding arm 21 is prevented from overrunning when the carriage reverses, the control is executed so that the electromagnet 26 is excited and caused to magnetically attract the steel band 28 on the side of the holding arm 21, and so that the holding arm 21 stops when the carriage 13 stops, and energizing the electromagnet 26 is stopped when the carriage 13 stops. Next, when the carriage 13 is reversed so as to move in the opposite direction, it is expected that the carriage 13 and the holding arm 21 are separated and only the carriage 13 moves unless the electromagnet 26 is energized and excited. However, in the case of separating the holding arm 21 in this way, it is feared that a stop position of the holding arm 21 is not stabilized. The reason is that even if the electromagnet 26 is energized and an attraction force as the second sliding resistance is made to act when the carriage decelerates, and thereafter, energizing the electromagnet 26 is stopped when the carriage reverses, a magnetized state by residual magnetism in the yoke 26*b* of the electromagnet 26 and the steel band 28 is kept, and the attraction force between the carriage 13 and the holding arm 21 does not disappear, with the result that the holding arm 21 is brought when the carriage 13 reverses and moves. In order to appropriately use leaving and bringing of the holding arm 21 by the carriage 13 with security, it is necessary to move the carriage 13 extra in anticipation of a part for the holding arm 21 to be brought back when the carriage 13 reverses.

By decreasing the value of electric current for energizing the electromagnet 26 while the carriage 13 is decelerating, it is possible to decrease the residual magnetism after the energizing is stopped, and clear up the bringing back when the carriage reverses. However, the excitation electric current is decreased and the attraction force of the electromagnet 26 to the steel band 28 is also decreased, and it is feared that the holding arm 21 continues movement and overruns after the carriage 13 stops. In a case where the holding arm 21 overruns, in order to bring the holding arm 21 next, it is necessary to move the carriage 13 extra in anticipation of the overrun so as not to fail to bring.

In a case where there is an influence of the residual magnetism on attraction by the electromagnet 26, a stroke of the movement of the carriage 13 must be increased anyway, and a portion of time not to execute knitting in movement of the carriage 13 increases, with the result that productivity is impaired. In order to solve this problem, it is necessary to avoid that the residual magnetism remains in the yoke 26*b* of the electromagnet 26 and the steel band 28.

Then, in the present embodiment, although the electromagnet 26 is energized and caused to attract in the decelerating region of the movement of the carriage 13 in the same manner as in FIG. 5, electric current of the opposite direction to the energization electric current is passed when the carriage reverses, whereby the electromagnet 26 is demagnetized and the residual magnetism in the yoke 26*b* and the steel band 28 is eliminated. Consequently, it is possible to secure a sufficient attraction force when attraction is required, eliminate an attraction force by the residual magnetism when separating the carriage 13 and the holding arm 21, stabilize a stop position of the holding arm 21, and eliminate a useless stroke from the movement of the carriage 21.

It is possible to demagnetize the electromagnet 26 by passing electric current in the opposite direction to excitation electric current. The timing to pass the electric current of the opposite direction can be either a stage that the carriage 13 stops at the end of the decelerating region of the carriage 13 or the first stage of the accelerating region after the carriage 13 stops and reverses, or can be both.

The problem of the residual magnetism is thought to result from the quality of the material of an attracting piece like the steel band 28 and the quality of the material of the yoke 26*b* of the electromagnet 26. In particular, since the steel band 28 requires wear resistance, a hard material is used. The hard material is commonly, at the same time, a hard magnetic substance on which residual magnetism easily remains. By changing the material of the steel band 28 and the yoke 28*b* to a soft magnetic substance, it is possible to make the residual magnetism hard to remain. However, in the case of a soft magnetic substance, hardness is lower and wear resistance is insufficient.

In demagnetization, electric current in the opposite direction to the excitation electric current is passed so as to avoid that a magnetization state continues though holding force H in a demagnetization curve showing a relationship between magnetic flux density B and holding force H of a ferromagnetic substance becomes 0 after excitation. Even if the demagnetization electric current is passed in the opposite direction, there is a possibility that residual magnetism of the opposite direction remains when energization is stopped. By regulating the magnitude of the demagnetization electric current, it is possible to decrease an attraction force by the residual magnetism of the opposite direction, and prevent the carriage 13 from bringing the holding arm 21 back when reversing. In the case of demagnetizing by AC current such that amplitude decreases, it is possible to securely demagnetize.

Figure 14:
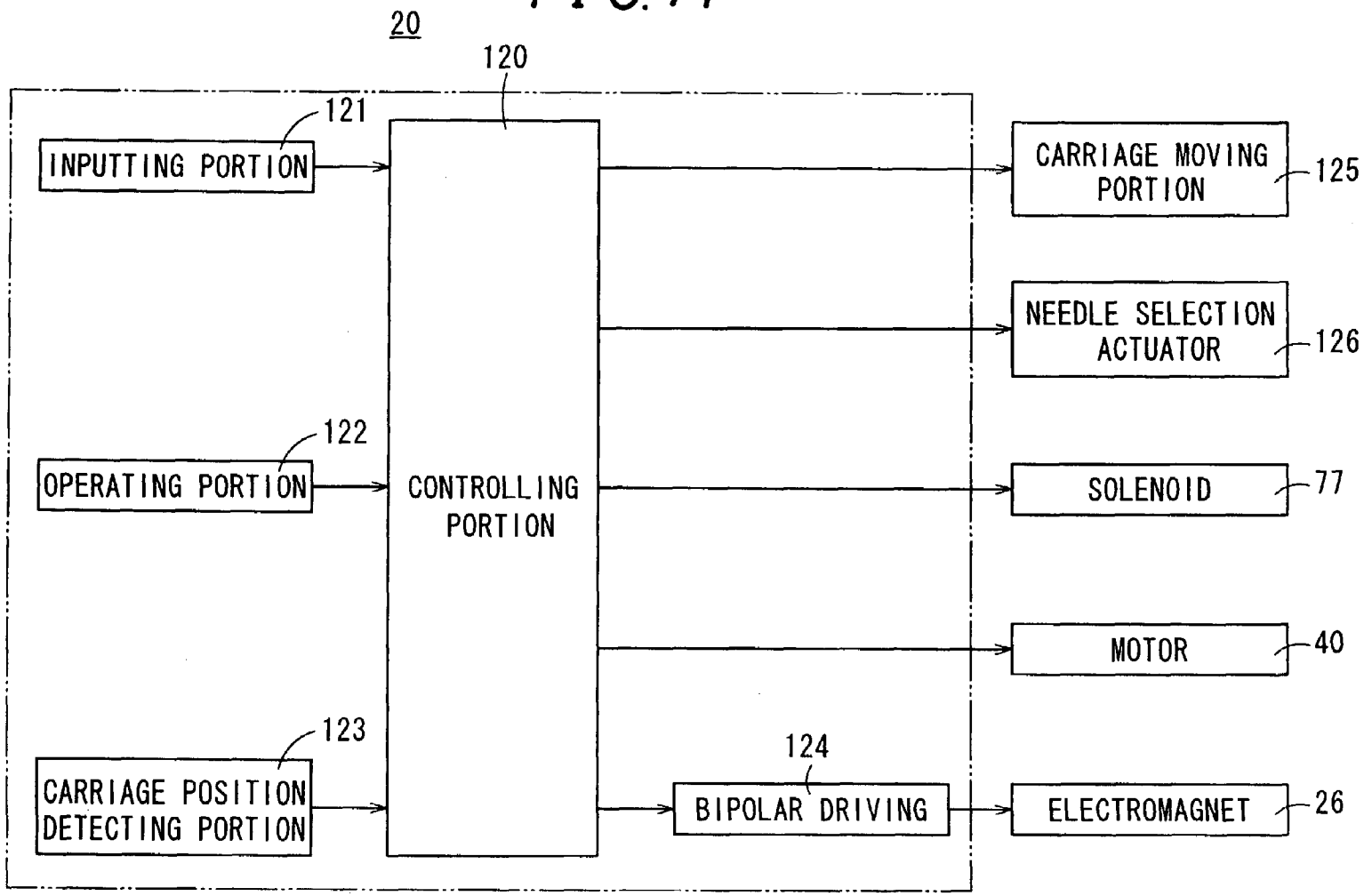
FIG. 14 is a block diagram showing a schematic electric configuration for executing bipolar driving of the electromagnet 26 in the embodiment of FIG. 13.

FIG. 14 shows a schematic electric configuration for bipolar driving which makes it possible to excite and demagnetize the electromagnet 26 in the control unit 20 of FIG. 1. The control unit 20 includes a controlling portion 120, an inputting portion 121, an operating portion 122, a carriage position detecting portion 123, and a bipolar driving circuit 124. The controlling portion 120 is realized including a microcomputer and the like, and executes control necessary for the weft knitting machine 11 to knit. The inputting portion 121 inputs knitting data on a fabric knitted by the weft knitting machine 11. The operating portion 122 is used when the operator or the like of the weft knitting machine 11 executes a direction operation. The carriage position detecting portion 123 detects whether or not the carriage 13 is in a specific position like the starting position of the needle bed 12. The bipolar driving circuit 124 is capable of energizing the coil 26*a* of the electromagnet 26 by switching the polarity to execute excitation in one direction and demagnetization in the other direction with DC current.

As to the driving of the carriage 13 in the weft knitting machine 11, the controlling portion 120 can control a carriage moving portion 125 so as to move the carriage 13 along the needle 12, control a needle selection actuator 125 so as to select the knitting needle 14, and so on. Moreover, the controlling portion 120 can control the solenoid 77 of the stopping device 19 so as to select whether or not the yarn feeder 16 is brought by the holder 18. Furthermore, the controlling portion 120 can control the motor 40 so as to change the connection of the holding arm 21 and the carriage 13.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, although the moving member persists in moving through inertia when the carriage that is bringing the moving member stops movement, the first sliding resistance is applied in-between the moving member and the stationary guide rail, and the second sliding resistance is applied in-between the moving member and the carriage having stopped moving, so that sliding resistance that is the sum of the first sliding resistance and the second sliding resistance acts on the stationary parts, and it is possible to promptly stop. Since the second sliding resistance does not act when the carriage brings the moving member, it is possible to reduce a load. When the carriage starts bringing the moving member, the moving member is substantially held back on the guide rail due to a difference between the first sliding resistance and the second sliding resistance, and it is possible to decrease sliding resistance that acts when bringing is started, and reduce occurrence of an impact and a noise.

Further, according to the invention, it is possible to apply the first sliding resistance and the second sliding resistance with stability at all times. Since the second sliding resistance is smaller than the first sliding resistance, it is possible to move only the carriage while the moving member is stationary on the guide rail until bringing of the moving member is started when the carriage reverses a moving direction.

Furthermore, according to the invention, since it is possible to control the second sliding resistance by the electromagnet, it is possible to increase the second sliding resistance and securely stop the moving member, when the carriage stops as well as when the moving member is separated. When the carriage reverses the moving direction, it is possible to make the second sliding resistance slightly smaller than the first sliding resistance, and reduce occurrence of an impact and a noise. Besides, it is possible to make the second sliding resistance that is controllable larger than the first sliding resistance, or gradually change. When separating the moving member from the carriage and stopping, it is possible to make the second sliding resistance larger than the first sliding resistance and instantly stop, thereby preventing an overrun. Additionally, it is possible to gradually increase the second sliding resistance when the carriage reverses for reciprocating in the decelerating region, and gradually decrease in the accelerating region, thereby softening an impact at the abutting time when the controlling member and the bringing member start engaging each other.

Still further, according to the invention, since the second sliding resistance applying means excites the electromagnet so as to apply the second sliding resistance at the deceleration stage before the carriage is separated from the moving member, it is possible to generate a sufficient attraction force between the carriage and the moving member, and stop the moving member as the carriage decelerates and stops, by the sliding resistance by the attraction force.

Still further, according to the invention, since the residual magnetism exits in a ferromagnetic substance part on which electromagnetic attraction acts even if energizing the electromagnet is stopped, it is possible to demagnetize the electromagnet and a magnetically attracting portion of the moving member, and clear up the residual magnetism. In such a case that the carriage reverses at low speed, the carriage and the moving member are not separated when the residual magnetism exists, and it is feared that the moving member is brought by the carriage when the carriage reverses the moving direction. In a case where excitation electric current to the electromagnet while the carriage is decelerating is decreased so that the residual magnetism becomes small when energizing the electromagnet is stopped, an attraction force between the carriage and the moving member becomes small, and it is feared that the moving member overruns through inertia. In a case where the moving member overruns when the carriage decelerates, the carriage must be moved in anticipation of the overrun in order that the carriage brings the moving member next, a movement stroke of the carriage increases, and a time required for movement of the carriage increases, so that productivity gets lower. Since the second sliding resistance applying means demagnetizes the electromagnet when the carriage reverses, the residual magnetism does not exist in the electromagnet even if the electromagnet is sufficiently excited so as not to cause an overrun, and it is possible to prevent the moving member from being brought undesirably when the carriage reverses.

Still further, according to the invention, since the second sliding resistance applying means excites the electromagnet by passing electric current of one direction therethrough, and demagnetizes by passing demagnetization electric current in the opposite direction to the one direction, it is possible to excite and demagnetize by bipolar driving in the one direction and the opposite direction.

Still further, according to the invention, it is possible to decrease occurrence of an impact and a noise accompanying conversion of a position where the controlling member and the engagement place for bringing of the bringing member abuts against each other when the carriage converts a direction, by utilizing an overrun by controlling the second sliding resistance at the time of a stop, or by controlling the second sliding resistance when bringing is started.

Still further, according to the invention, it is possible to securely a stop the holding arm such that the mass larger than in the case of using the yarn feeder alone and inertia at the time of a stop is also large, by increasing sliding resistance acting at the time of a stop, and decrease occurrence of an impact and a noise by decreasing substantial sliding resistance to the guide rail when the carriage converts a direction.

The invention claimed is:

1. An apparatus for applying sliding resistance for a weft knitting machine, which applies sliding resistance to a moving member which is brought by a carriage and slides in a longitudinal direction of a needle bed in a weft knitting machine, the apparatus comprising:

a guide rail disposed in parallel to the longitudinal direction of the needle bed, the moving member being able to slidably move on the guide rail;

connection switching means which is capable of carrying out switching between a state where the moving member and the carriage are connected and the carriage brings the moving member, and a state where the connection is released and the carriage does not bring the moving member;

first sliding resistance applying means for applying first sliding resistance in-between the guide rail and the moving member; and second sliding resistance applying means for applying second sliding resistance in-between the moving member and the carriage, and making the second sliding resistance smaller than the first sliding resistance at least when the carriage reverses a moving direction.

2. The apparatus of claim 1, wherein the first sliding resistance applying means is provided with a first permanent magnet which generates magnetic attraction and applies the first sliding resistance; and the second sliding resistance applying means is provided with a second permanent magnet which generates magnetic attraction and applies the second sliding resistance smaller than the first sliding resistance.

3. The apparatus of claim 1, wherein the first sliding resistance applying means is provided with a permanent magnet which generates magnetic attraction and applies the first sliding resistance; and the second sliding resistance applying means is provided with an electromagnet which generates magnetic attraction and applies the second sliding resistance, and which can control the magnetic attraction and make the second sliding resistance smaller than the first sliding resistance at least just before the moving member is brought, by switching of the connection switching means, into a state where it is brought by the carriage.

4. The apparatus of claim 3, wherein the second sliding resistance applying means energizes the electromagnet and applies the second sliding resistance when the moving member being brought by the carriage is separated and stopped.

5. The apparatus of claim 4, wherein when the moving member is separated, the second sliding resistance applying means excites the electromagnet so as to apply the second sliding resistance, and thereafter, demagnetizes the electromagnet and a magnetically attracting portion of the moving member.

6. The apparatus of claim 5, wherein the second sliding resistance applying means excites the electromagnet by passing electric current of one direction therethrough, and demagnetizes by passing demagnetization electric current in a direction opposite to the one direction.

7. The apparatus of claim 1, wherein the connection switching means has:

a controlling member disposed to one of the carriage and the moving member, being capable of controlling a deformation state; and a bringing member which is disposed to the other of the carriage and the moving member, and has an engagement place for bringing that can engage with the controlling member when the controlling member is in a predetermined deformation state.

8. The apparatus of claim 1, wherein the moving member is a holding arm which holds a yarn carrier having a yarn feeding port for feeding a knitting yarn at a tip thereof, in a position where the yarn feeding port faces a knitting needle in knitting operation.

* * * * *